US007886381B2

(12) United States Patent
Aiken et al.

(10) Patent No.: US 7,886,381 B2
(45) Date of Patent: Feb. 15, 2011

(54) RECONFIGURABLE SUPPORT PILLOW SYSTEM

(75) Inventors: Brian L. Aiken, East Aurora, NY (US); Mary G. Mastrosimone-Gese, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/353,488

(22) Filed: Jan. 14, 2009

(65) Prior Publication Data

US 2010/0175192 A1 Jul. 15, 2010

(51) Int. Cl.
*A47C 20/00* (2006.01)

(52) U.S. Cl. ..... 5/632; 5/655; 5/636; 5/657

(58) Field of Classification Search ..... 5/632, 5/655, 636, 657
See application file for complete search history.

(56) References Cited

U.S. PATENT DOCUMENTS

| | | | | |
|---|---|---|---|---|
| 941,043 | A * | 11/1909 | Powell | 5/657 |
| 1,386,652 | A * | 8/1921 | Patton | 5/636 |
| D117,862 | S | 11/1939 | Bauer | |
| 3,512,189 | A | 5/1970 | Swanson | |
| 4,171,549 | A | 10/1979 | Morrell et al. | |
| 4,345,345 | A | 8/1982 | Holtz | |
| 4,624,021 | A | 11/1986 | Hofstetter | |
| D289,354 | S | 4/1987 | Willey | |
| 4,794,657 | A | 1/1989 | Avery | |
| D311,472 | S | 10/1990 | Giles | |
| 4,959,880 | A | 10/1990 | Tesch | |
| 4,967,428 | A | 11/1990 | Browder | |
| 4,984,315 | A | 1/1991 | Ortman et al. | |
| 5,018,790 | A | 5/1991 | Jay | |
| 5,103,516 | A | 4/1992 | Stevens | |
| 5,107,558 | A | 4/1992 | Luck | |
| 5,269,323 | A | 12/1993 | Krouskop | |
| 5,432,967 | A | 7/1995 | Raftery | |
| 5,497,519 | A | 3/1996 | Mintz | |
| 5,504,953 | A | 4/1996 | Singer-Leyton et al. | |
| D369,934 | S | 5/1996 | Straub et al. | |
| 5,682,633 | A | 11/1997 | Davis | |
| D408,676 | S | 4/1999 | Straub et al. | |
| 5,978,990 | A | 11/1999 | Akey | |

(Continued)

FOREIGN PATENT DOCUMENTS

JP 2001046184 A 2/2001

(Continued)

OTHER PUBLICATIONS

International Search Report for PCT/US2010/020591, Aug. 23, 2010.

*Primary Examiner*—Robert G Santos
*Assistant Examiner*—Brittany M Wilson
(74) *Attorney, Agent, or Firm*—Edell, Shapiro & Finnan, LLC

(57) ABSTRACT

A reconfigurable support pillow system is disclosed. The system includes a base pillow, a first accessory pillow, and a second accessory pillow. The accessory pillows are removable, with the first accessory pillow being configured to connect to the second accessory pillow to form a nursing pillow that supports an infant. The system may be utilized as a prenatal pillow, comfortably supporting an expectant mother, or may be utilized as a postnatal pillow, supporting a nursing mother and/or her infant.

20 Claims, 11 Drawing Sheets

U.S. PATENT DOCUMENTS

| | | | | |
|---|---|---|---|---|
| 6,006,381 | A | 12/1999 | Tandrup | |
| 6,024,762 | A | 2/2000 | Gray | |
| 6,081,950 | A | 7/2000 | Selton | |
| D431,745 | S | 10/2000 | Jackson | |
| 6,151,735 | A | 11/2000 | Koby et al. | |
| 6,499,164 | B1 | 12/2002 | Leach | |
| 6,578,218 | B2 | 6/2003 | Wassilefsky | |
| 6,601,252 | B1 | 8/2003 | Leach | |
| 6,645,235 | B1 | 11/2003 | Blackwell | |
| 6,735,798 | B1 | 5/2004 | Sekizawa | |
| 6,751,817 | B1 | 6/2004 | Leach | |
| 6,754,924 | B1 | 6/2004 | Brady et al. | |
| 6,760,934 | B1 | 7/2004 | Leach | |
| 6,779,211 | B1 | 8/2004 | Williams | |
| 6,874,183 | B1 | 4/2005 | Taylor | |
| 6,886,201 | B1 | 5/2005 | Weiss-Lohrei | |
| 7,000,273 | B2 | 2/2006 | Rivera-Wienhold et al. | |
| 7,322,061 | B2 | 1/2008 | Carroll | |
| 7,536,735 | B1 * | 5/2009 | Stump | 5/632 |
| 7,562,406 | B1 * | 7/2009 | Leach | 5/632 |
| 2005/0210590 | A1 | 9/2005 | DiGirolamo | |
| 2005/0278864 | A1 | 12/2005 | Leach | |
| 2006/0042012 | A1 | 3/2006 | Littlehorn | |
| 2006/0288485 | A1 * | 12/2006 | Fox | 5/632 |
| 2007/0067914 | A1 * | 3/2007 | Littlehorn et al. | 5/632 |

FOREIGN PATENT DOCUMENTS

| | | | |
|---|---|---|---|
| JP | 2001070099 | A | 3/2001 |

* cited by examiner

RECONFIGURABLE SUPPORT PILLOW SYSTEM

FIELD OF THE INVENTION

The present invention is directed toward a reconfigurable support and, in particular, to a pillow including a primary pillow and secondary pillows coupled to the primary pillow, as well as a method of forming the pillows.

BACKGROUND OF THE INVENTION

Numerous types of pillows have been proposed for supporting either a child or an adult, but seldom both. Most pillow designs concentrate on supporting one specific area of the human body and are shape-limited (not allowing for the same pillow to be used in a variety of positions). These designs, moreover, fail to accommodate people of different sizes and shapes using the same pillow in many diverse positions. In addition, these pillows lack the ability to be reconfigured to provide varying degrees of support to differing users.

SUMMARY OF THE INVENTION

A reconfigurable support pillow system is disclosed. The system includes a base pillow, a first accessory pillow releasably coupled to a first portion of the base pillow, and a second accessory pillow releasably coupled to a second portion of the base pillow. The first accessory pillow connects to the second accessory pillow to form a nursing pillow operable to support an infant. The system may be utilized as a prenatal pillow, comfortably supporting an expectant mother, or may be utilized as a postnatal pillow, supporting a nursing mother and/or her infant.

BRIEF DESCRIPTION OF THE DRAWINGS

Like reference numerals have been used to identify like elements throughout this disclosure.

DETAILED DESCRIPTION OF THE INVENTION

Figure 1:
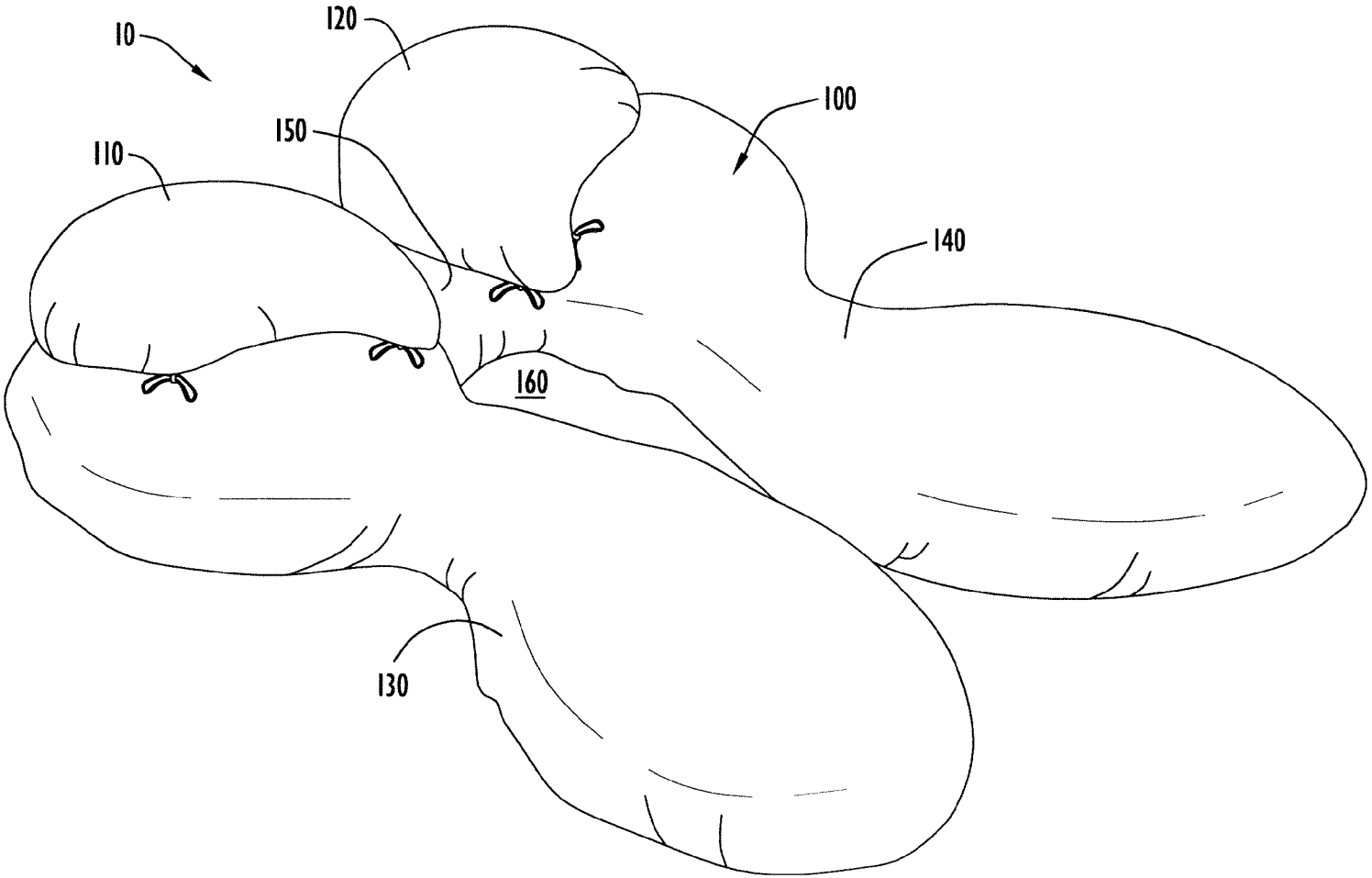
FIG. 1 illustrates a perspective view of a reconfigurable support pillow system in accordance with an embodiment of the present invention.

FIG. 1 is a perspective view of the reconfigurable support pillow system in accordance with an embodiment of the present invention. As shown, the reconfigurable support pillow 10 may include a base or body pillow 100, a first accessory or head pillow 110, and a second accessory or head pillow 120. The body pillow 100 includes a first body portion 130 connected to a second body portion 140 via a bridge portion 150. The body portions 130, 140 and the bridge portion 150 define a well 160 capable of receiving at least a portion of a user. The body pillow 100 and the accessory pillows 110, 120 may be formed from soft, supple natural or synthetic material such as cotton, polyester, or mixtures thereof. The pillows 100, 110, 120, moreover, may be filled with batting material (e.g., polyester fiber), or may be filled with other materials such as feathers or viscoelastic material (e.g., viscoelastic foam).

Figure 2:
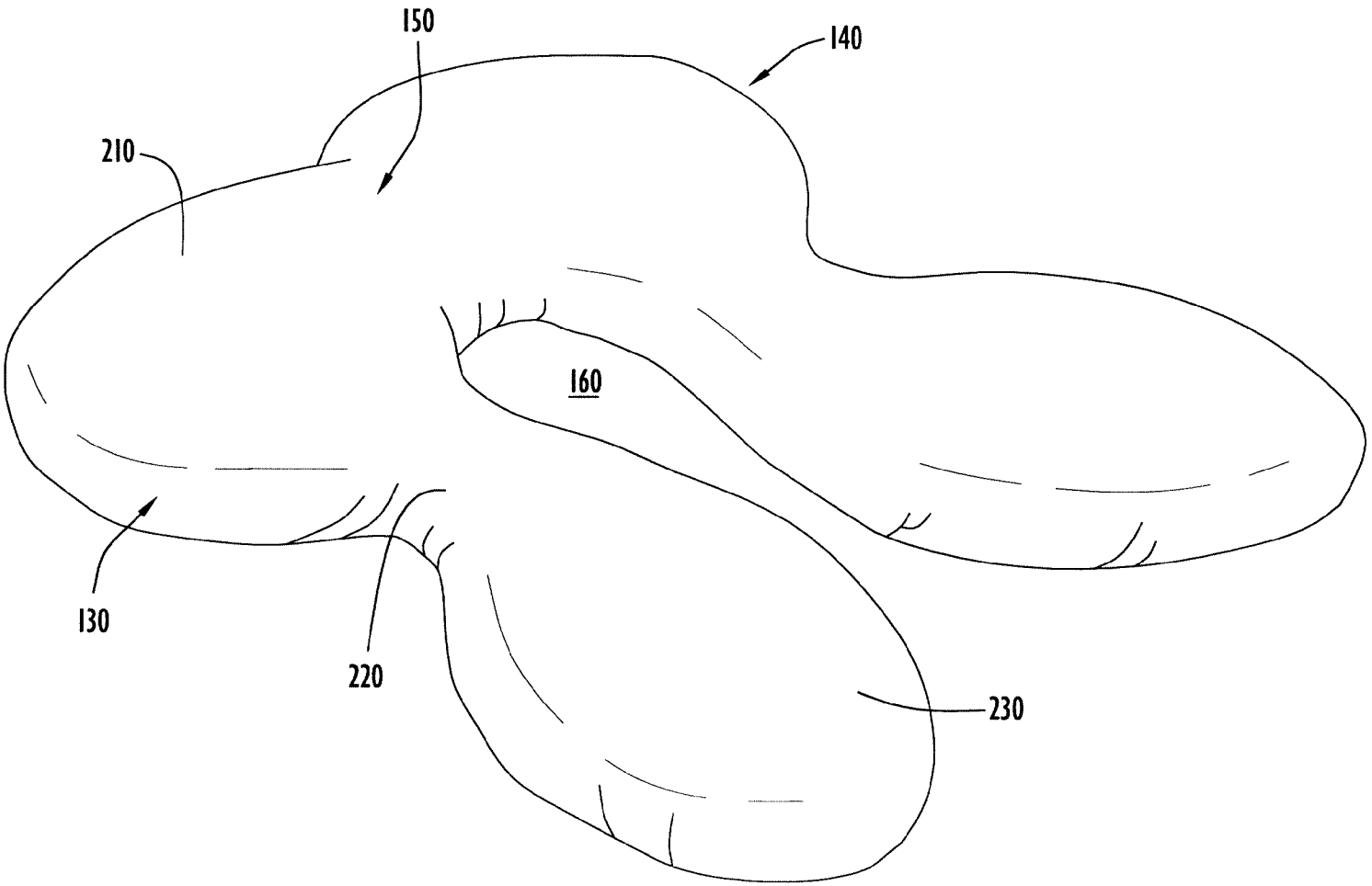
FIG. 2 an isolated, perspective view of a base pillow in accordance with an embodiment of the present invention.

FIG. 2 is a perspective view of the body pillow 100 shown in isolation. Each body portion 130, 140 includes a head section 210, a center or and intermediate section 220, and a foot section 230. The head section 210 may be contoured to support the head/torso of a user. Similarly, the foot section 230 may be contoured to support the legs/knees of a user. As illustrated in the embodiment of FIG. 2, each of the head section 210 and the foot section 230 defines enlarged pillow areas, being wider than the intermediate section 220 of the body portions 130, 140.

The shape of the body pillow 100 may be configured to support a user while in seated, supine, or side-lying positions. For example, the body portions 130, 140 may be contoured as mirror images of each other and/or possess a shape similar to that of a butterfly wing. Specifically, the head section 210 may be contoured as the forewing portion of a butterfly wing, and the foot section 230 may be contoured as the hindwing portion of a butterfly wing. This shape creates a body pillow 100 that provides additional support in key user areas (the user's head and feet), while enabling the reconfiguration of the body pillow 100 via folding along both the bridge portion 150 and the intermediate section 220 (explained in greater detail below).

The height (thickness) of the body pillow 100 may remain generally consistent; alternatively, the height may vary in a predetermined manner between the various portions and sections of the pillow.

Figure 3A:
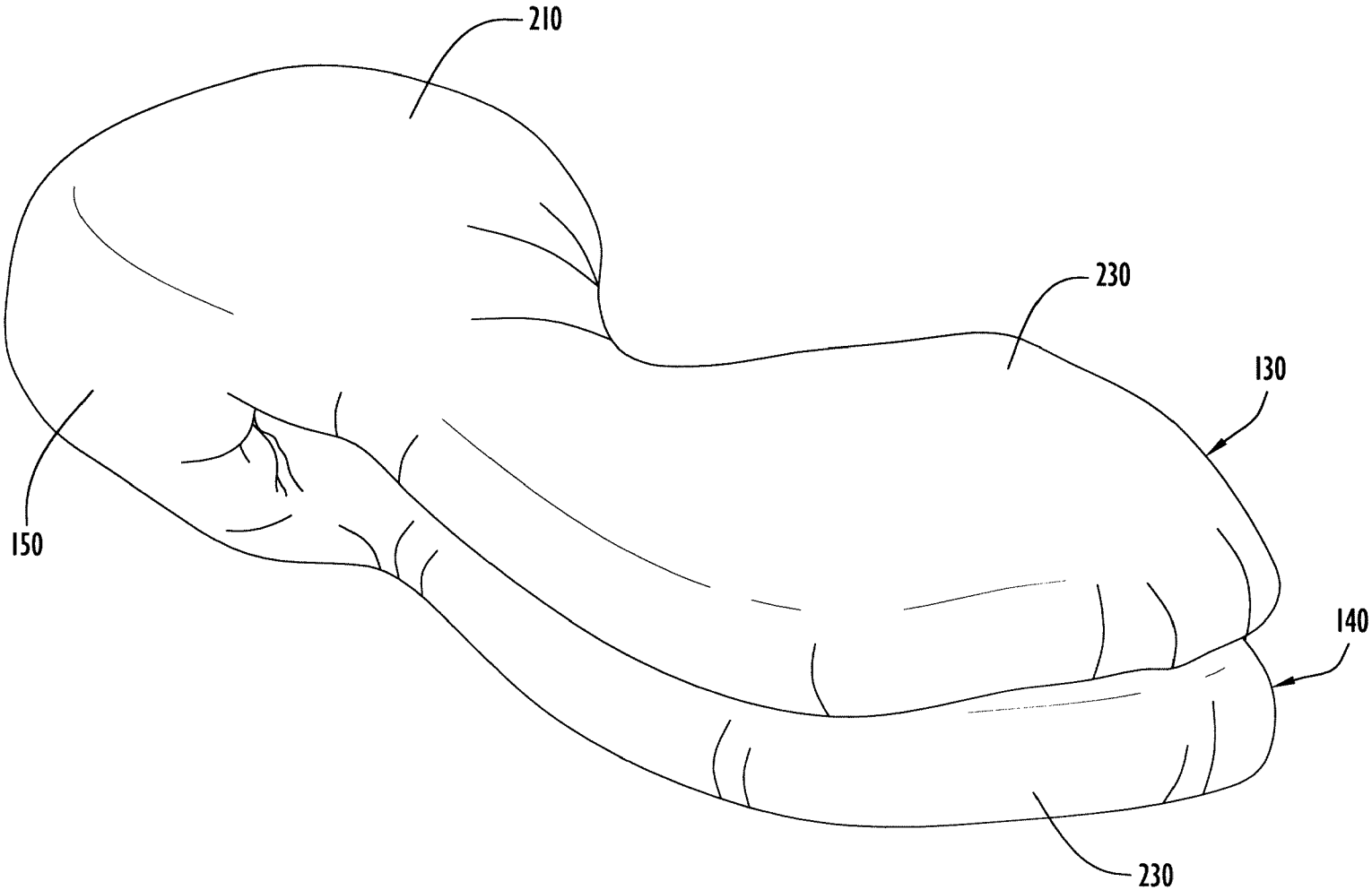
FIG. 3A illustrates the base pillow of FIG. 2 shown in a first folded configuration.
Figure 3B:
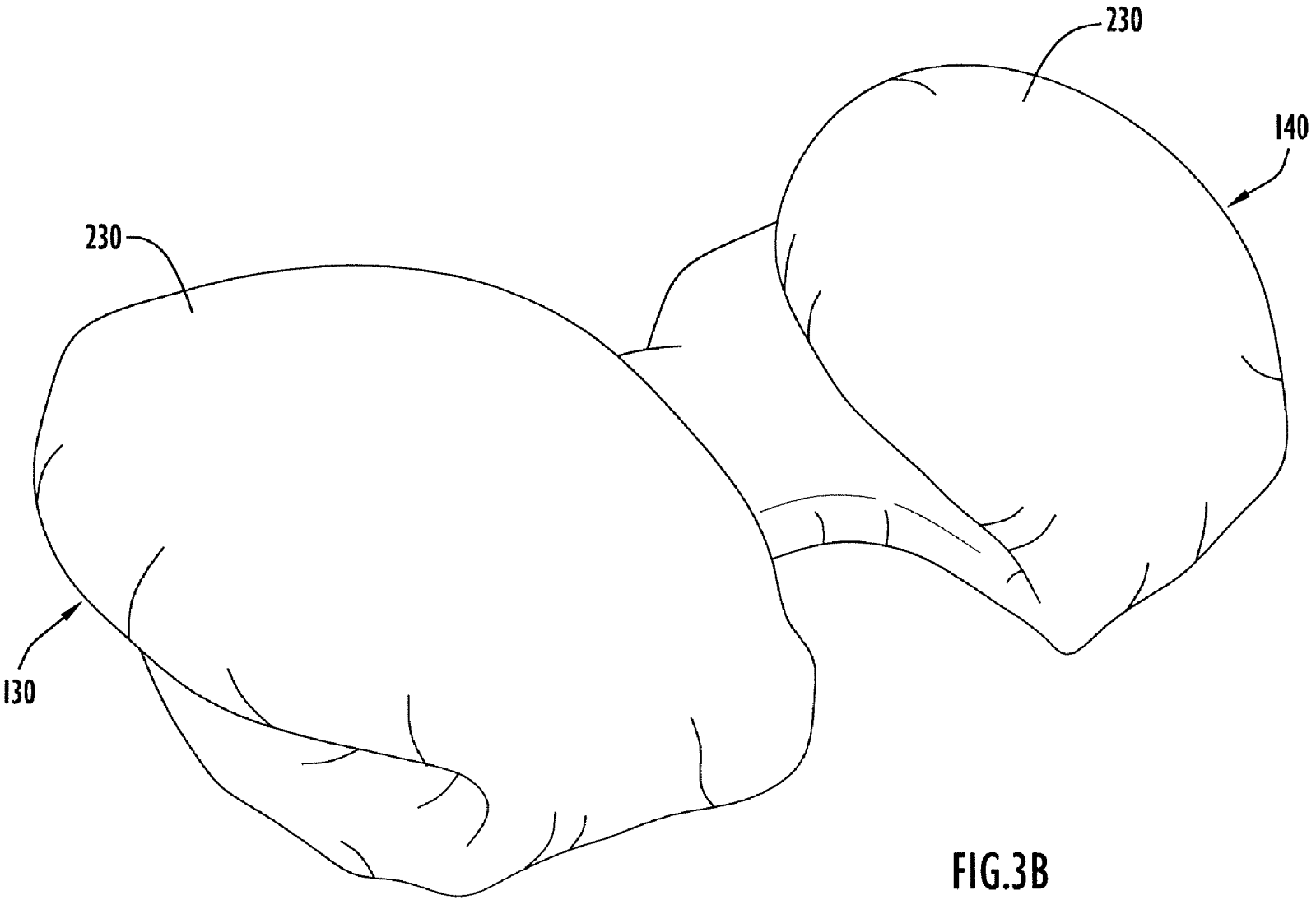
FIG. 3B illustrates the base pillow of FIG. 2 shown in a second folded configuration.

Referring to FIGS. 3A and 3B, the body pillow 100 is reconfigurable into a variety of pillow configurations. Specifically, the body pillow 100 may be folded either along the bridge 150 or along the intermediate section 220. Referring to FIG. 3A, the first body portion 130 may be folded on top of the second body portion 140 (or vice versa) to increase the height of the body pillow 100, providing additional support for a user. Similarly, the body pillow 100 may be folded along the intermediate section 220 such that the foot section 230 of each body portion 130, 140 is folded onto its corresponding head section 210, or vice versa (seen in FIG. 3B). To this end, the density of the fill material in the areas of the intermediate section 220 and/or the bridge 150 may be less than that of the head section 210 and the foot section 230 to help permit the folding of body pillow 100 in the above-mention configurations.

Figure 4A:
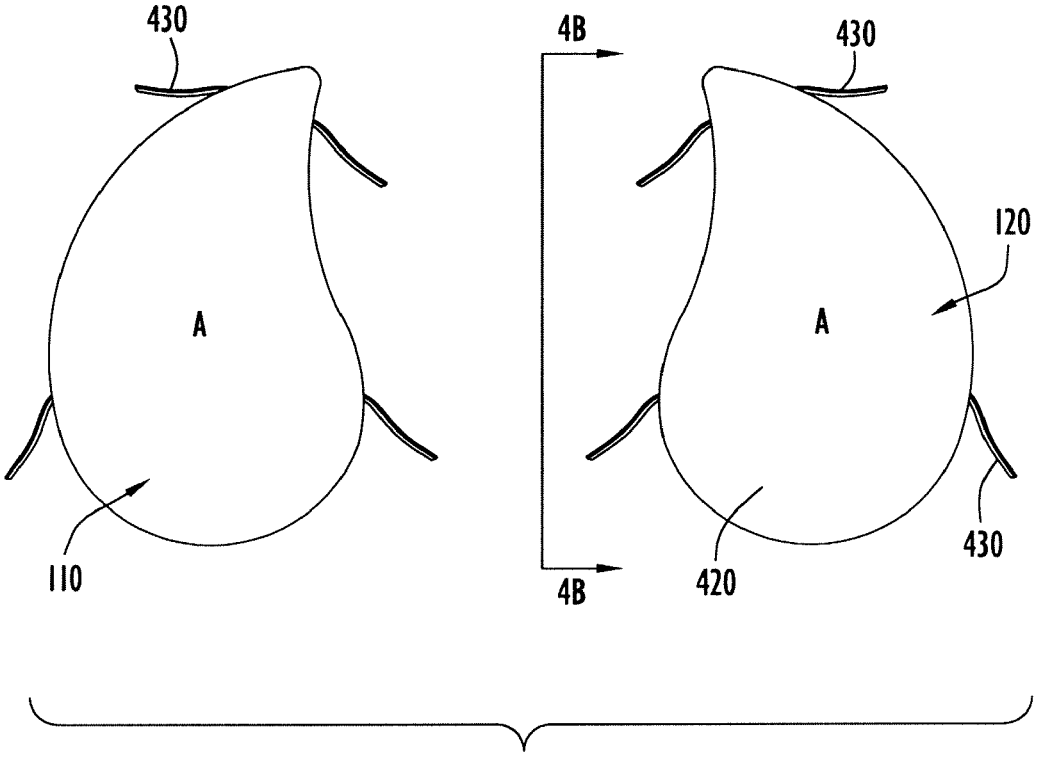
FIG. 4A is a front, isolated view of the first and second accessory pillows of FIG. 1.

Referring back to FIG. 1, the first accessory pillow 110 may be removably coupled to the head section 210 of the first body portion 130. Similarly, the second accessory pillow 120 may be removably coupled to the head section 210 of the second body portion 140. FIG. 4A is a front view of the accessory pillows 110, 120 in isolation. As shown, each accessory pillow 110, 120 may possess a substantially teardrop or bean shape with a generally pointed or narrow end 410 (see FIG. 5A) and a generally rounded or wide end 420. The accessory pillows 110, 120 may further include one or more connection members 430 to couple the accessory pillows to the body pillow 100, as well as to each other (discussed in greater detail below). The connection members 430 are not particularly limited. By way of example, the connection members 430 may include, but are not limited to, straps (as illustrated), buttons, snaps, ties, hook-and-loop fasteners, etc.

Figure 4B:
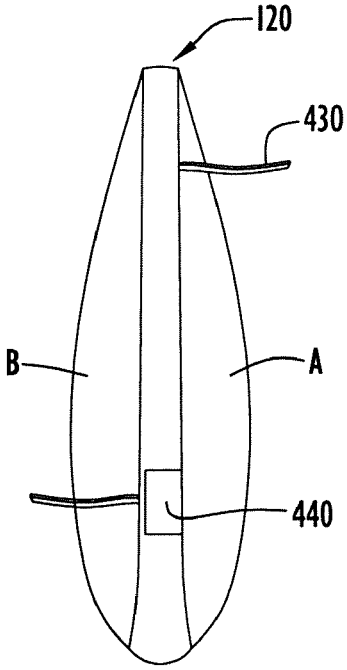
FIG. 4B illustrates a side view of one of the accessory pillows of FIG. 4A taken along line 4B-4B of FIG. 4A.

The height of the accessory pillows 110, 120 may be generally consistent; alternatively, the height may vary. FIG. 4B illustrates a side view of an accessory pillow 110, 120 of FIG. 4A (taken along line 4B-4B of FIG. 4A). In the embodiment illustrated, the height of the pillow tapers upward traveling from the generally pointed end 410 to the generally rounded end 420, providing a highly contoured head support when connected to the body pillow 100. Each accessory pillow 110, 120, moreover, includes a first or front side A and a second or rear side B, as well as may include a pocket 440 operable to securely store a connection member 430 when not in use.

Figure 5A:
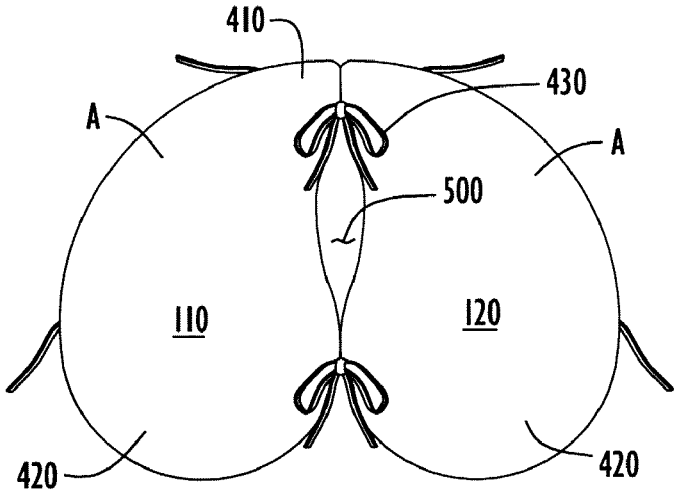
FIGS. 5A-5C illustrate plan views of the accessory pillows of FIG. 4A coupled to one another in various configurations.
Figure 5B:
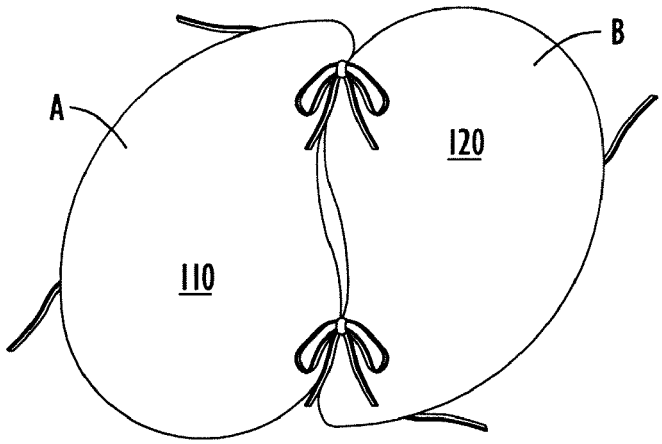
Figure 5C:
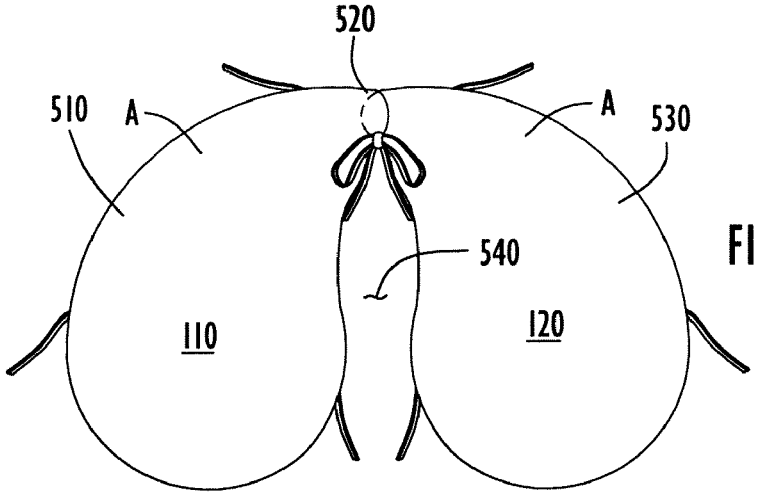

The accessory pillows 110, 120 may be oriented in a plurality of configurations. FIGS. 5A-5C illustrate the accessory pillows of FIG. 4A coupled in various support configurations. By way of example, the accessory pillows 110, 120 may be coupled to each other via connection members 430 at two points of contact. In FIG. 5A, the first accessory pillow 110 is coupled to the second accessory pillow 120 such that the generally pointed end 410 of the first accessory pillow 110 is fastened to the generally pointed 410 of the second accessory pillow 120, while the generally rounded end 420 of the first accessory pillow 110 is fastened to the generally rounded end 410 of the second accessory pillow 120. This creates a pillow support having a generally O-shaped configuration that defines an enclosed, generally oval well 500.

Alternatively, as shown in FIG. 5B, the generally pointed end 410 of the first accessory pillow 110 may be fastened to the generally rounded end 420 of the second accessory pillow 120. Conversely, the generally rounded end 420 of the first accessory pillow 110 may be fastened to the generally pointed end 410 of the second accessory pillow 120. This creates a pillow support having a generally closed, smaller, well.

The accessory pillows 110, 120 may also be coupled to each other via connection members 430 along only one contact. Referring to FIG. 5C, the generally pointed end 410 of the first accessory pillow 110 may overlap and/or be fastened to the generally pointed end 410 of the second accessory pillow 120 to create a generally U-shaped structure including a first arm 510, a medial portion 520, and a second arm 530. The pillows 110, 120 define an open well 540 operable to receive at least a portion of a user (e.g., it may wrap partially or completely around a user's waist). This functions as a traditional nursing pillow, in which the user is oriented in the well 540, and the pillows 110, 120 being placed on the user's lap.

Figure 6:
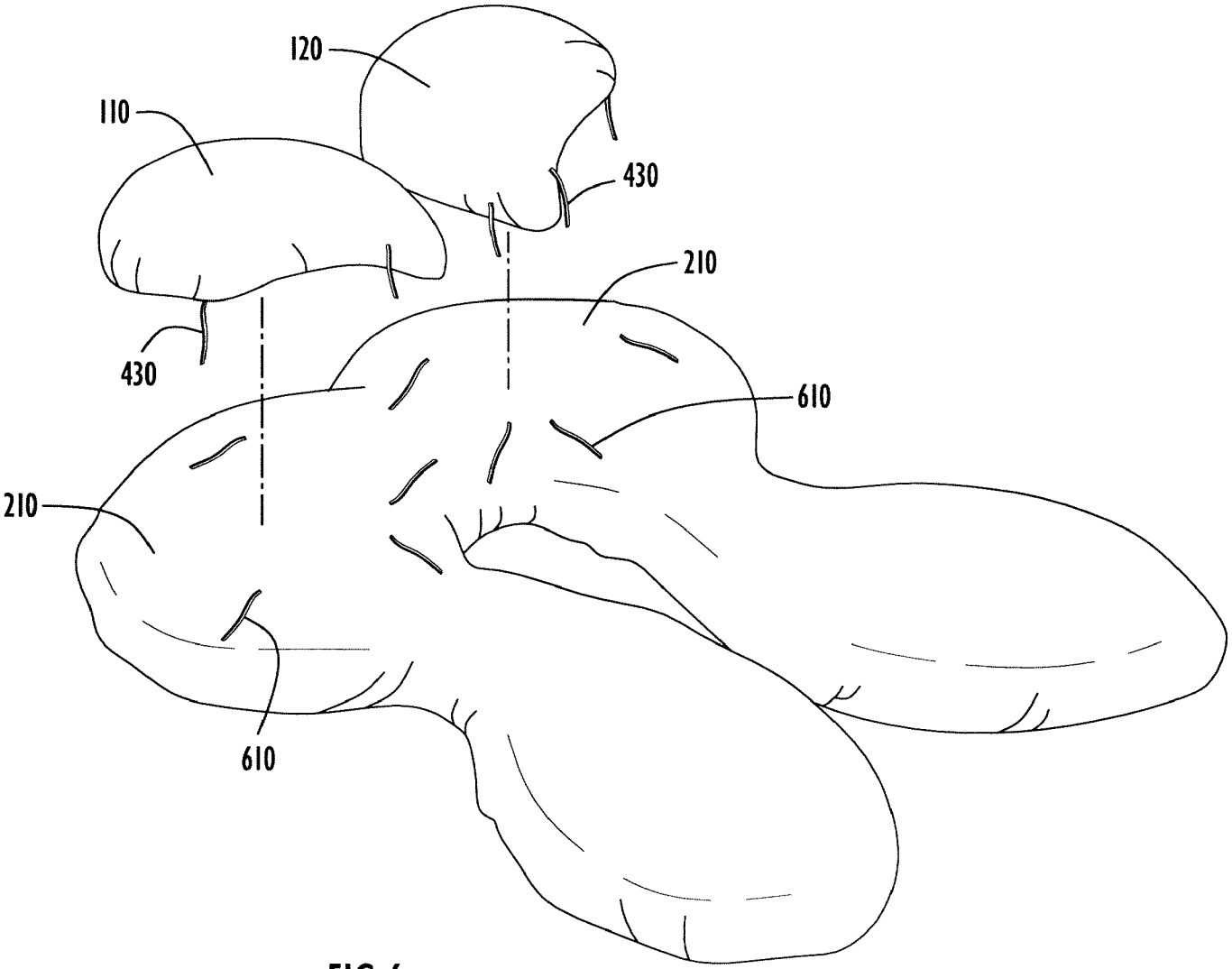
FIG. 6 illustrates an exploded view of the reconfigurable support pillow system shown in FIG. 1, showing the connection of the accessory pillows to the base pillow.
Figure 7:
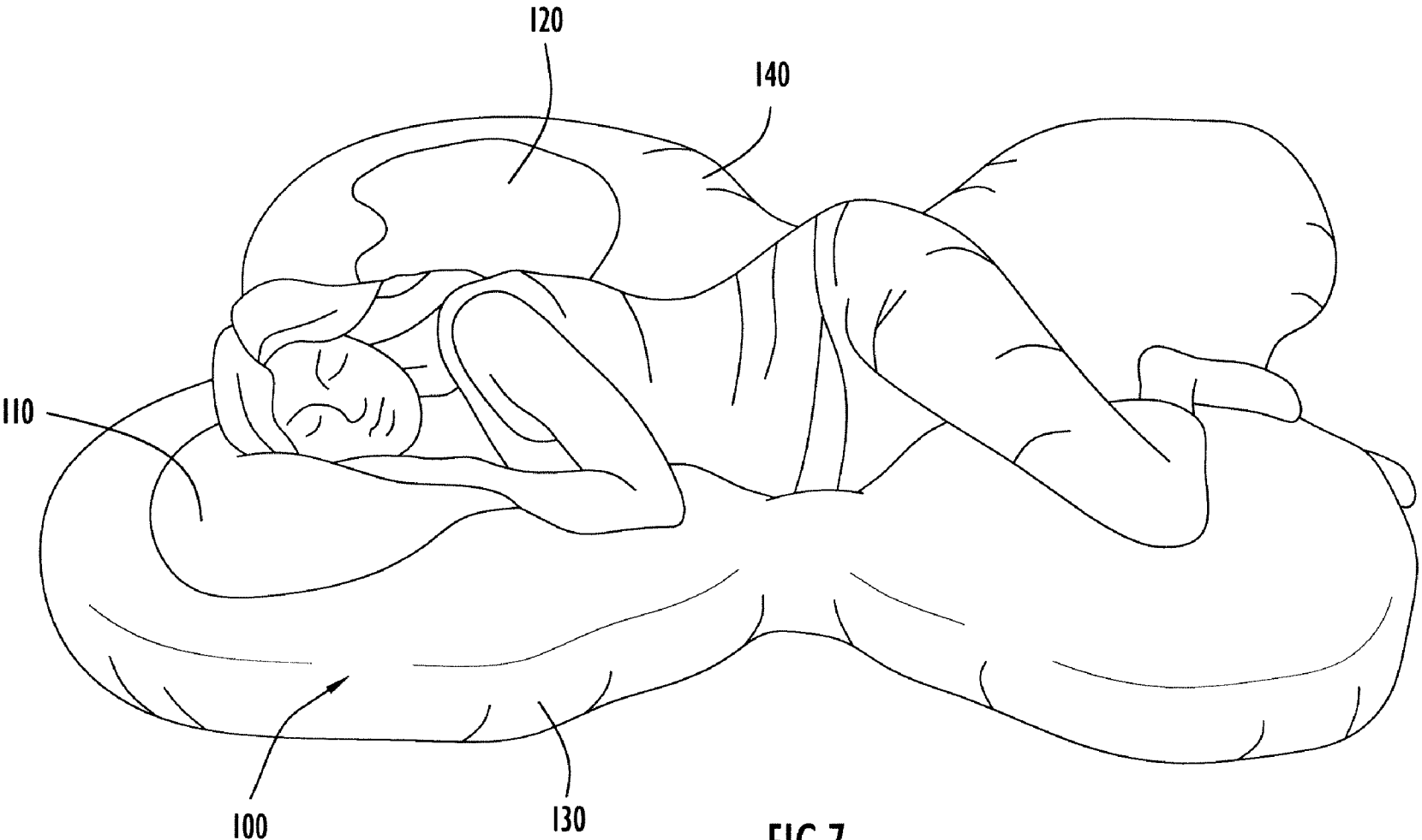
FIG. 7 illustrates the reconfigurable pillow system of FIG. 1, showing a mode of use in accordance with an embodiment of the invention.
Figure 8:
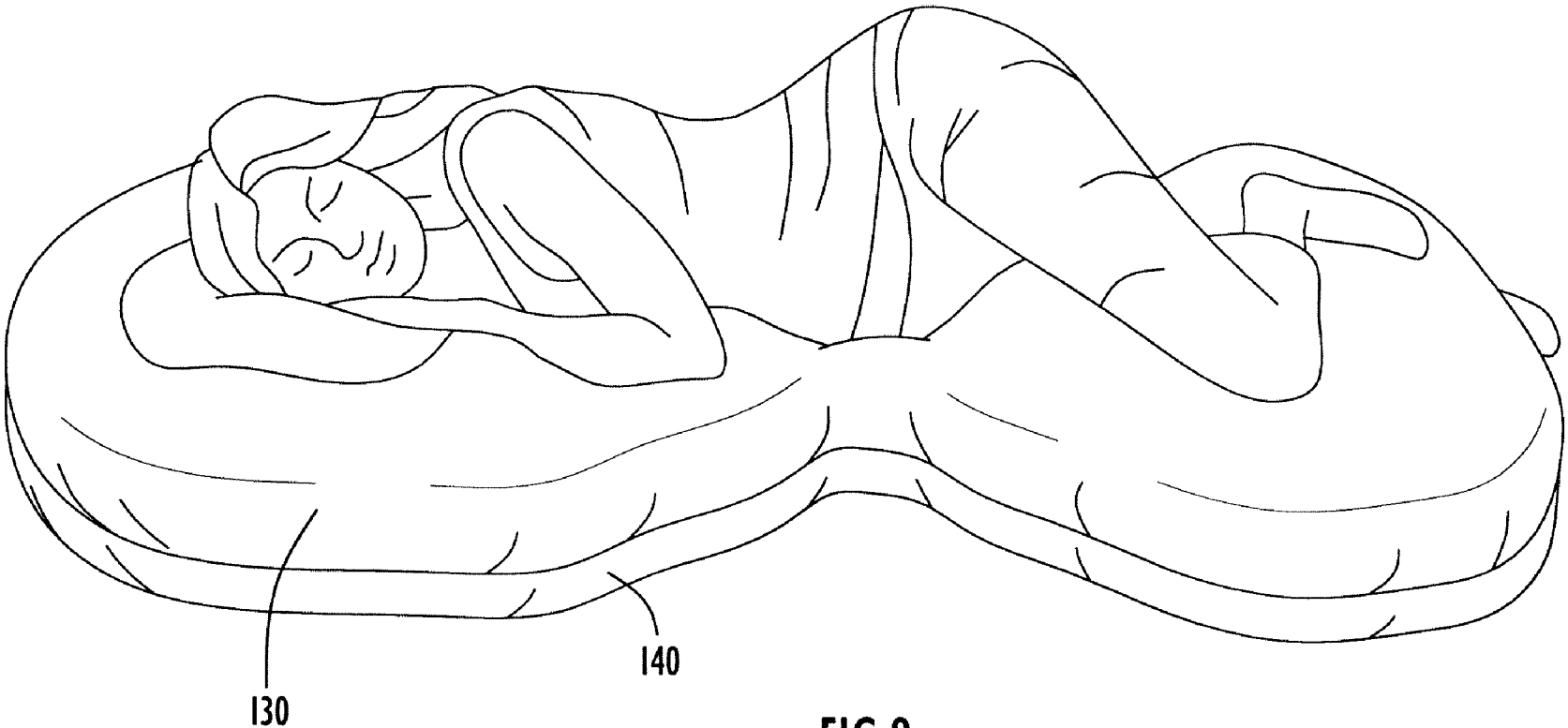
FIG. 8 illustrates the reconfigurable pillow system of FIG. 1, showing a mode of use in accordance with another embodiment of the invention.

The connection members 430 on the accessory pillows 110, 120 further enable the releasable connection of the accessory pillows 110, 120 to the body pillow 100. FIG. 6 is an exploded view of the body pillow 100 and accessory pillows 110, 120 of FIG. 1. As shown, the body pillow 100 includes connection members 610 oriented in positions complementary to the connection members 430 of the accessory pillows 110, 120. As a result, a user can selectively connect the accessory pillows 110, 120 to (or disconnect from) the body pillow 100 by engaging (or disengaging) the connection members 430, 610.

The operation of the support pillow system is explained with reference to FIGS. 7-10. The system 10 may begin in a first configuration, wherein the accessory pillows 110, 120 are mounted onto the body pillow 100, and the body portions 130, 140 are disposed flat on a supporting surface (e.g., a floor, a bed, etc.). As shown, a user may lay on her side, setting her head on the either the bridge 150 or on an accessory pillow 110, 120 (FIG. 7), optionally positioning her body within the body pillow well 160. Alternatively, the body pillow 100 may be reconfigured into a stacked configuration (FIG. 8), folding the body pillow 100 along the bridge portion 150 such that the first body portion 130 is positioned on the second body portion 140. The user again sets her head on an accessory pillow 110, 120, optionally straddling the one or both of the stacked body portions 130, 140.

Figure 9:
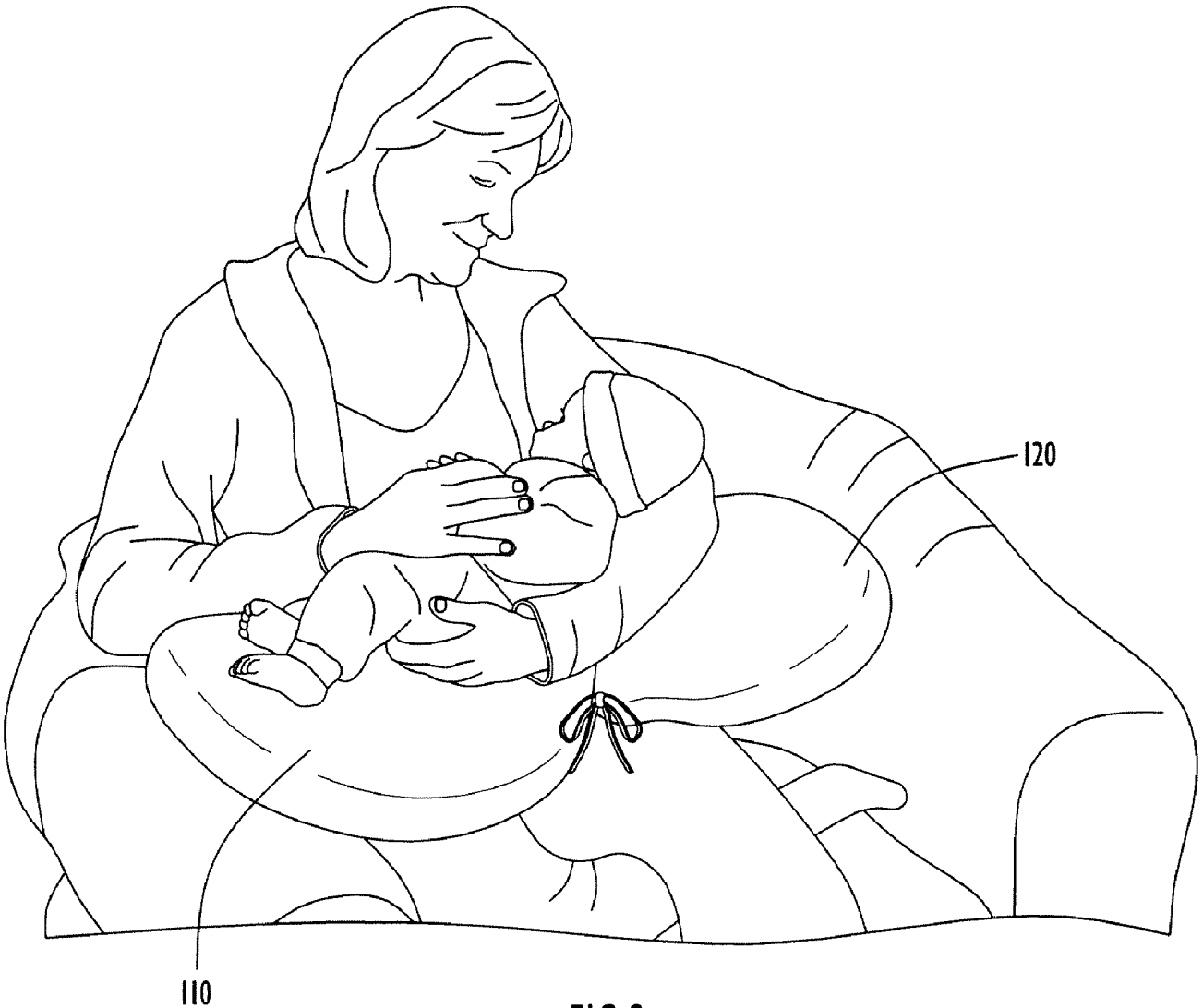
FIG. 9 illustrates the accessory pillows of FIG. 4A, showing a first mode of use for the accessory pillows in accordance with an embodiment of the invention
Figure 10:
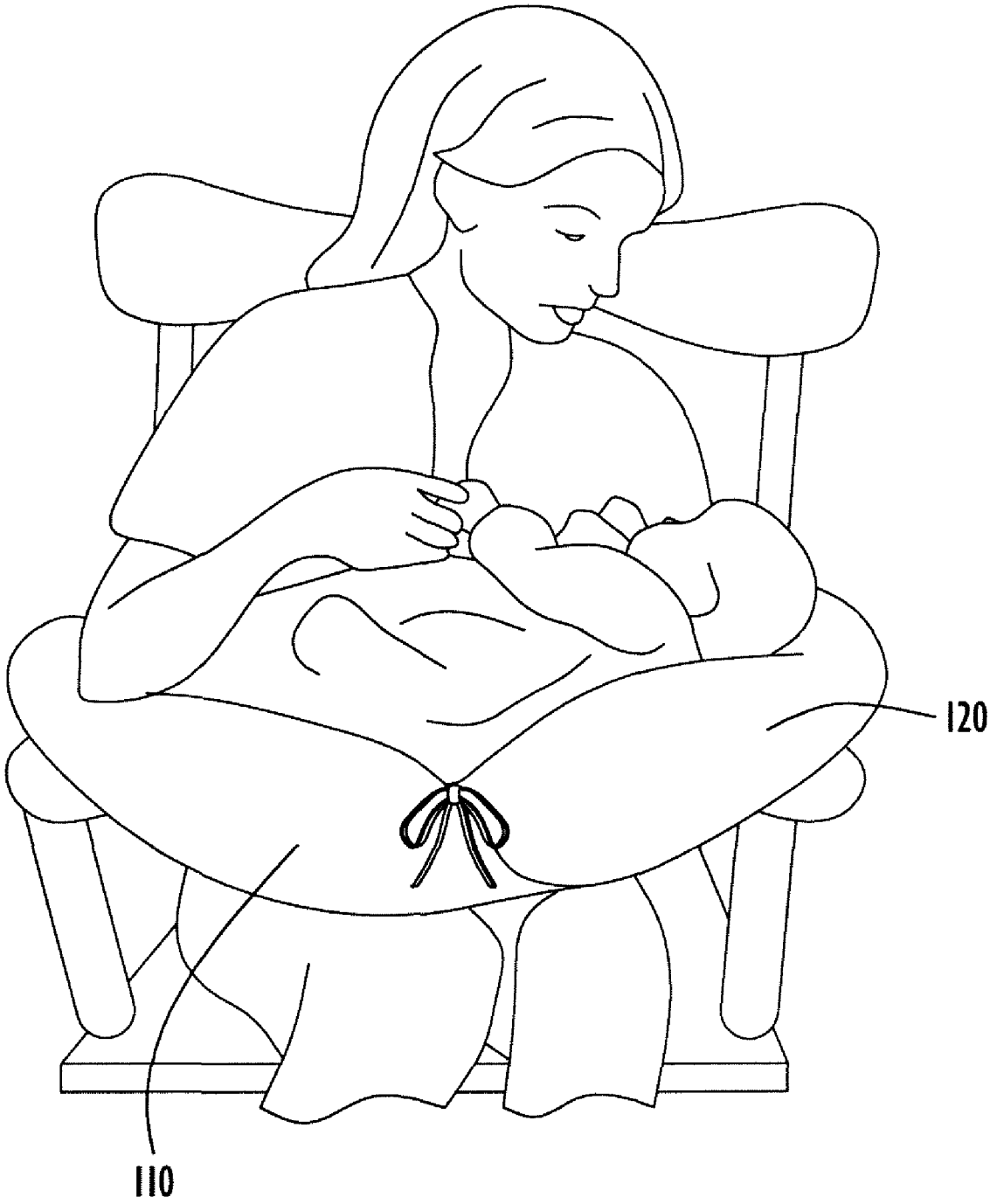
FIG. 10 illustrates the accessory pillows of FIG. 4A, showing a second mode of use for the accessory pillows in accordance with another embodiment of the invention.

Referring to FIG. 9, the accessory pillows 110, 120 may be removed from the body pillow 100 and connected along a single point of attachment as described above (see FIG. 5C). The user may set the connected accessory pillows 110, 120 in her lap, positioning herself within the open well 540 and supporting an infant on the connected pillows 110, 120. Finally, as shown in FIG. 10, the removed accessory pillows 110, 120 may be coupled along two points of attachment as described above (see FIGS. 5A and 5B), with an infant positioned within the enclosed well 500.

As should be understood, other configurations of the support pillow system 10 are possible simply by selectively connecting the accessory pillows 110, 120 to the body pillow 100 and/or selectively folding the body pillow 100.

While the invention has been described in detail and with reference to specific embodiments thereof, it will be apparent to one skilled in the art that various changes and modifications can be made therein without departing from the spirit and scope thereof. For example, the body pillow 100 and accessory pillows 110, 120 can be of any size and shape, and may be formed from any suitable materials. The body pillow 100 and accessory pillows 110, 120 may be made of the same or of different materials. For example, the body 100 and accessory pillows 110 may be formed from cotton material, polyester or any other suitable, flexible and/or washable material. The filler material may include down, feathers, polyester fiber (fiberfill) or other natural or synthetic filler material. The interior of the body 100 and/or accessory pillows 110, 120 may possess a segmented cavity, including a plurality of cells that may be filled with filler material at various amounts of fill density. The exterior of the body and/or accessory pillows may include handles, external pockets, or connection points for toys, etc. The body pillow 100 may further include additional padding (e.g., additional fill material, gel packs, hot/cold packs, etc.) situated within selected areas of the user. For example, additional padding may be disposed in areas corresponding to the head, belly, knees, and legs of a user.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A reconfigurable support pillow system comprising:

a base pillow operable to support a user, the base pillow including:

a first elongated base pillow member comprising a first head portion and a first foot portion;

a second elongated base pillow member comprising a second head portion and a second foot portion, and a connector pillow coupling the first base pillow member to the second base pillow member, wherein the base pillow members and the connector pillow cooperate to define a well between the first base pillow member and the second base pillow member;

a first accessory pillow configured to selectively couple to the first base pillow member; and a second accessory pillow configured to selectively couple to the second base pillow member, wherein the first accessory pillow is further adapted to selectively couple to the second accessory pillow to form a combined support pillow capable of supporting an infant.

2. The pillow system of claim 1, wherein the connector pillow is configured to permit the folding of the first base pillow member onto the second base pillow member such that the first and second base pillow members are arranged in a stacked configuration.

3. The pillow system of claim 1, wherein the accessory pillows couple in a first connection mode, wherein the accessory pillows form a curved, generally U-shaped support defining a medial portion and two end portions, and a second connection mode, in which the accessory pillows form a generally O-shaped structure defining an enclosed well.

4. The pillow system of claim 1, wherein:

the first accessory pillow includes a first end portion and a second end portion;

the second accessory pillow comprises a first end portion and a second end portion; and the accessory pillows couple in a both a first connection mode, in which the first end portion of the first accessory pillow is coupled to the first end portion of the second accessory pillow, and a second connection mode, in which the first end portion of the first accessory pillow is coupled to the first end portion of the second accessory pillow and the second end portion of the first accessory pillow is coupled to the second end portion of the second accessory pillow.

5. The pillow system of claim 1, wherein the first accessory pillow couples to the second accessory pillow via a fastener selected from the group consisting of straps, ties, and hook-and-loop fasteners.

6. The pillow system of claim 1, wherein each accessory pillow couples to the base pillow via a fastener selected from the group consisting of straps, ties, and hook-and-loop fasteners.

7. The pillow system of claim 1, wherein:

at least one of the first and second accessory pillows is defined by a structure having first end and a second end, wherein the transverse dimension of the first end is less than the transverse dimension of the second end such that first end defines a narrow end and the second end defines a wide end; and the thickness of the at least one accessory pillow tapers upward in the direction of the wide end such that the thickness of the at least one accessory pillow at the narrow end is less than the thickness of the pillow at the wide end.

8. The pillow system of claim 7, wherein:

each of the first end and the second end includes a releasable fastener, and the narrow end of the first accessory pillow is configured to be secured to the wide end of the second accessory pillow via the releasable fasteners.

9. The pillow system of claim 1, wherein the first base pillow member is contoured as a mirror image of the second base pillow member.

10. The pillow system of claim 1, wherein:

the first accessory pillow includes fasteners disposed at predetermined locations along the exterior of the first accessory pillow; and the first base pillow member includes fasteners oriented at positions complementary to the fasteners of disposed on the first accessory pillow such that the fasteners disposed on the first accessory pillow generally align with the fasteners of the first base pillow member.

11. The pillow system of claim 10, wherein:

the second accessory pillow includes fasteners disposed at predetermined locations along the exterior of the second accessory pillow; and the second base pillow member includes fasteners oriented at positions complementary to the fasteners of the second accessory pillow such that the fasteners disposed on the second accessory pillow generally align with the fasteners of the second base pillow member.

12. The pillow system of claim 1, wherein each accessory pillow connects to its corresponding base pillow member along multiple points of attachment.

13. The pillow system of claim 1, wherein:

the head portion of each base pillow member possesses a first transverse dimension;

the foot portion of each base pillow member possesses a second transverse dimension; and each base pillow member further comprises an intermediate portion disposed intermediate the head and foot support portions, the intermediate portion possessing a third transverse dimension; and the third transverse dimension of the intermediate portion is less than each of the first transverse dimension and second transverse dimension.

14. The pillow system of claim 1, wherein:

each base pillow member comprises a body pillow operable to support the body of a user;

each head portion is configured to support a head of the user;

each foot portion is configured to support legs or feet of the user; and each accessory pillow couples to the head portion of its corresponding base pillow member.

15. The pillow system of claim 14, wherein:

the first and second base pillow members each comprises a top surface adapted to contact a user and a bottom surface adapted to contact a supporting surface; and each accessory pillow connects to the top surface of its corresponding base pillow member.

16. A reconfigurable support pillow system comprising:

a body pillow including:

a first body pillow member operable to support a user, a second body pillow member operable to support the user, and a bridging pillow coupling the first body pillow member to the second body pillow member, wherein the bridging pillow orients the first body pillow member in spaced relation from the second body pillow member;

a first accessory pillow configured to removably couple to the first body pillow member; and a second accessory pillow configured to removably couple to the second body pillow member, wherein, when each of the first and second accessory pillows is separated from the body pillow, the first accessory pillow is further configured to couple to the second accessory pillow to form a combined support pillow capable of supporting an infant.

17. The reconfigurable support pillow system of claim 16, wherein:

the first body pillow member comprises a head portion operable to support the head of a user and a foot portion operable to support the legs or feet of the user; and the second body pillow member comprises a head portion operable to support the head of a user and a foot portion operable to support the legs or feet of the user.

18. The reconfigurable support pillow system of claim 16, wherein:

the first accessory pillow includes a first end portion and a second end portion;

the second accessory pillow comprises a first end portion and a second end portion; and the accessory pillows couple to each other in a first connection mode, in which the first end portion of the first accessory pillow is coupled to the first end portion of the second accessory pillow and the second end portions of the accessory pillows are not connected;

the accessory pillows further couple to each other in a second connection mode, in which the first end portion of the first accessory pillow is coupled to the first end portion of the second accessory pillow and the second end portion of the first accessory pillow is coupled to second end portion of the second accessory pillow; and the accessory pillows further couple to each other in a third connection mode, in which the first end portion of the first accessory pillow is coupled to the second end portion of the second accessory pillow and the second end portion of the first accessory pillow is coupled to first end portion of the second accessory pillow.

19. The reconfigurable support pillow system of claim 16, wherein:

each body pillow member comprises a top surface configured to receive the user and a bottom surface configured to contact a supporting surface; and each accessory pillow couples to the top surface of its corresponding body pillow member.

20. The reconfigurable support pillow system of claim 17, wherein:

the head portion of each body pillow member possesses a first transverse dimension;

the foot portion of each body pillow member possesses a second transverse dimension;

each body pillow member further comprises an intermediate portion disposed intermediate the head and foot portions, the intermediate portion possessing a third transverse dimension; and the third transverse dimension of the intermediate portion is less than each of the first transverse dimension and second transverse dimension to defined a narrowed area between the head and foot portions.

* * * * *